United States Patent [19]

Sartore

[11] 4,020,530

[45] May 3, 1977

[54] SECURABLE MULTI-PURPOSE CLAMP AND INSERTS

[76] Inventor: James J. A. Sartore, 128 Morris St., Albany, N.Y. 12208

[22] Filed: Dec. 15, 1975

[21] Appl. No.: 640,882

[52] U.S. Cl. ..... 24/252 R; 24/253; 24/263 SB; D8/395

[51] Int. Cl.[2] ..... A44B 21/00

[58] Field of Search ..... 24/252 R, 263 SB, 137 A, 24/253, 248 T; D8/259

[56] References Cited

UNITED STATES PATENTS

| | | | |
|---|---|---|---|
| 2,667,678 | 2/1954 | Hargrave et al. | 24/253 |
| 2,680,877 | 6/1954 | Thornton | 24/253 |
| D214,527 | 6/1969 | Mazeika | D8/259 |

FOREIGN PATENTS OR APPLICATIONS

| | | | |
|---|---|---|---|
| 605,936 | 6/1926 | France | 24/253 |
| 389,096 | 8/1908 | France | 24/263 SB |
| 1,026,294 | 4/1953 | France | 24/253 |

*Primary Examiner*—Paul R. Gilliam
*Assistant Examiner*—Victor N. Sakran

[57] ABSTRACT

Multi-purpose clamp comprised of tubular clamp elements which contain releaseably secured clamping devices built into its walls, to hold inserts in place. The inserts being tubular and containing releaseably secured clamping devices, housed within and forming part of the tubular clamp elements. These inserts containing jaws at their extremities to exert biting or holding force at the point where they meet or come together.

1 Claim, 4 Drawing Figures

SECURABLE MULTI-PURPOSE CLAMP AND INSERTS

BACKGROUND OF THE INVENTION

This invention relates generally to clamps and in particular to new and improved clamps having tubular elements, in which jaw combinations, configuration can be changed by the use of tubular inserts. Both containing releasable securing devices to hold anything which is placed therein.

A multi-purpose clamp for holding within its tubular elements pencils, wires or similar articles is disclosed and claimed in U.S. Pat. No. D235,134 issued May 20, 1975 to the inventor of the present invention.

Some problems and limitations which this invention solves are:

First, the inserts or similar articles placed within the tubular clamp elements can now be secured therein.

Secondly, although the same clamp size can be used in many instances it is limited by its jaw composition, shape and configuration. This problem is solved because the jaws can be change to accomodate the job to be accomplished.

Thirdly, different surfaces, although near each other, sometimes could use different type jaws. This is solved by the use of inserts, making it possible to mix and match the desired jaw combinations.

Other uses and benifits will become apparent during this disclosure.

SUMMARY OF THE INVENTION

This invention is a new improved and novel securable multi-purpose clamp and inserts, which can be made of any material desired. The clamp is comprised of tubular elements containing securing means in its walls and having clamp jaws formed where they meet or come together. The clamp wall contains spring retaining means to hold the spring in position to keep the end opposite the jaws diverged and exert pressure on the jaws.

Inserts containing jaws at there extremities can be housed and secured in place within the tubular elements of the clamp. They become part of the clamp element and in effect become the acting clamp jaws. They are tubular, preserving the tubular shape of the clamp element and containing securing means to hold whatever is inserted therein.

The principle objective of this invention is to provide a tubular clamp in which the jaws can be easily changed eliminating the need for a number of different type clamps to perform varied tasks. This is accomplished by means of inserts which can be made of any material desired. They are then placed within the clamp tubular element and effectively become the acting element, when secured in position.

A further objective is to secure any article that is placed within the tubular element of the clamp. This is to prevent undesired movement.

Another objective is to maintain the tubular and securing features of the clamp elements by building it into the insert.

These and other advantages of the invention will become apparent after a study of the drawing and after reviewing the written specification describing the preferred embodiment. Like numerals are employed to designate like parts throughout same.

DESCRIPTION OF THE PREFERRED EMBODIMENT

Figure 2:
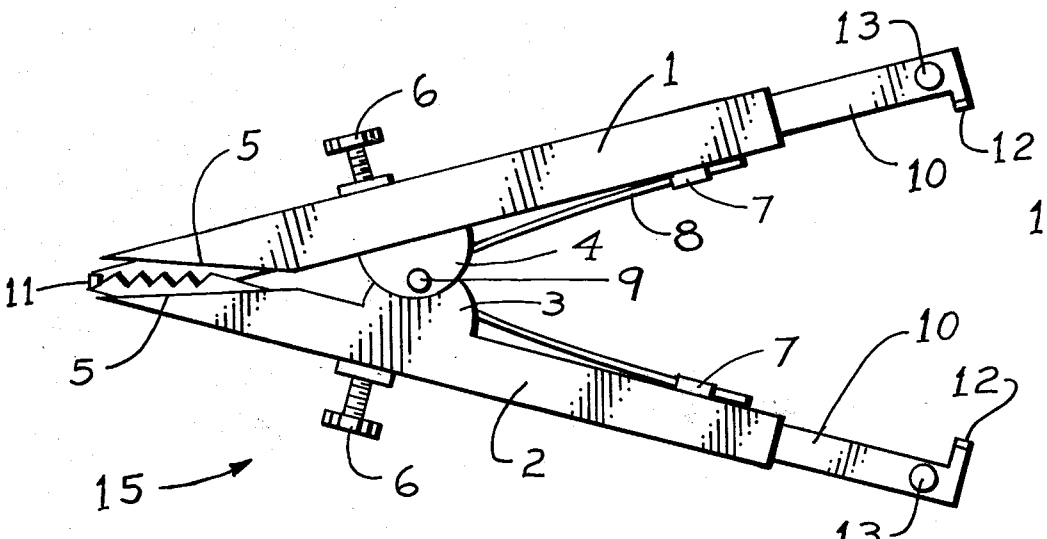
FIG. 2 is a side elevation thereof.

Referring to the drawing in general and particularly to FIG. 2 of the drawing is shown the new securable multi-purpose clamp and insert shown generally by the numeral 15 which can be formed of plastic or any material desired.

Figure 4:
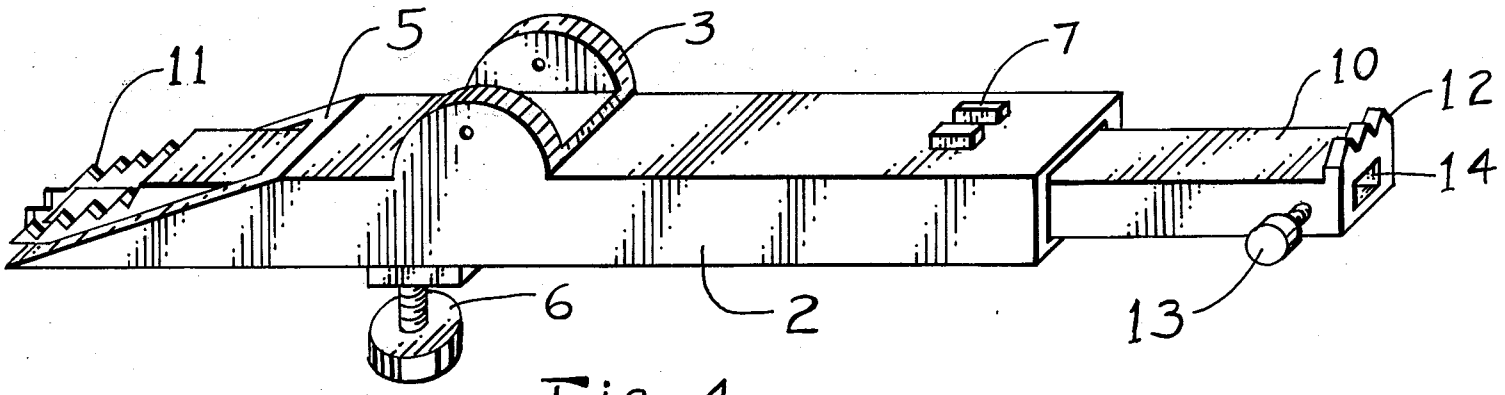
FIG. 4 is a perspective view of the lower clamp element with a part broken away and a part in section.

Each of the following parts such as upper tubular clamp element 1, lower tubular clamp element 2, or insert 10 may each be constructed in a one piece configuration shown in FIG. 4 or may be constructed in more than one piece by providing manufactured joints where required.

Figure 3:
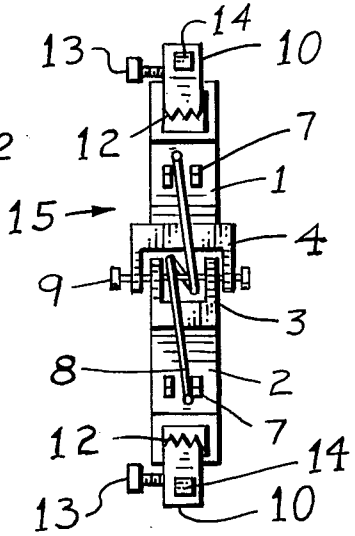
FIG. 3 is a right end elevational view.
Figure 1:
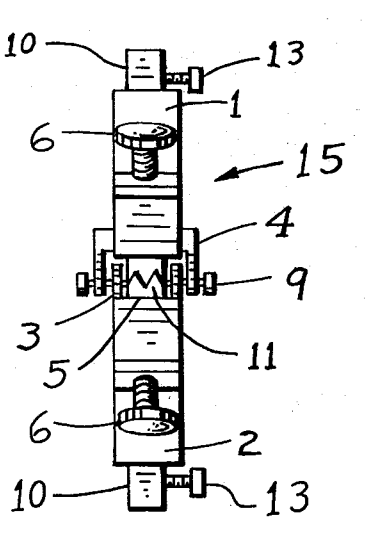
FIG. 1 is a left end elevational view of a securable multi-purpose clamp and insert as seen from the left of FIG. 2.

The inserts 10 are tubular containing front insert jaws 11 and rear insert jaws 12 see FIGS. 1, 2 and 4 with insert opening 14 running through the longitudinal portion, see FIGS. 3 and 4 and with alignment opening 16 see FIG. 4. These inserts are maintained in position by the use of clamp securing devices 6.

The securable multi-purpose clamp is comprised of an upper tubular clamp element 1 which is part of the upper interconnected projection 4 and lower tubular clamp element 2 which is part of lower interconnected projection pin 3, see FIG. 2. Both are held together by the pivot pin 9. Pressure is exerted by spring 8 held by the pivot pin 9 and spring retaining means 7 causing the spring to diverge the tubular clamp elements 1 and 2, which results in pressure being exerted on the jaws 5.

The tubular structure of the upper and lower clamp elements 1 and 2 will accept the inserts placed therein. Once inside they effectively become part of the clamp elements 1 and 2 and can be fastened into position by clamp securing devices 6. The front insert jaws 11 effectively take over for the clamp jaws 5. Also since the inserts are tubular items such as wires or similar articles can be held in position by inserting securing devices 13, see FIG. 1 through 4.

When the job calls for a different jaw type or arrangement, it can be accomplished very easily, clamp securing devices 6 are released allowing the inserts to be removed, rotated and reinstalled. This will place the rear insert jaws 12 in a position to effectively act as the clamp jaws 5. They can then be held in place by using clamp securing devices 6, see FIGS. 2 and 4.

It is to be understood that the aforementioned invention shown and described is to taken as a preferred example of the same and that various changes relative to material, size, shape and arrangement of parts may be resorted to without departing from the spirit of the invention and the subjoined claims.

What I claim is:

1. A multipurpose clamp comprising a pair of elongated hollow tubular members attached near their midsections thereof by a pivot pin; spring biasing means operably associated with each of said tubular members and said pivot pin whereby the opposite ends of each of said tubular members are automatically biased, by said spring to converge at one end thereof and diverge at the opposite end; each of said tubular members are adapted to receive therein jaw inserts at each end thereof; threaded means are provided at one end of each of said tubular members to retain said jaw inserts therein; the opposite ends of each of said tubular member are adopted to receive hollow tubular jaw inserts screw means attached to each of said hollow tubular jaw inserts to operably connect additional jaw inserts in said hollow tubular inserts.

* * * * *